US010280589B2

(12) United States Patent
Oka

(10) Patent No.: US 10,280,589 B2
(45) Date of Patent: May 7, 2019

(54) HYDRAULIC DRIVE APPARATUS FOR CONSTRUCTION MACHINE

(71) Applicant: KOBELCO CONSTRUCTION MACHINERY CO., LTD., Hiroshima-shi (JP)

(72) Inventor: Hidekazu Oka, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 173 days.

(21) Appl. No.: 15/118,538

(22) PCT Filed: Jan. 7, 2015

(86) PCT No.: PCT/JP2015/050240
§ 371 (c)(1),
(2) Date: Aug. 12, 2016

(87) PCT Pub. No.: WO2015/122213
PCT Pub. Date: Aug. 20, 2015

(65) Prior Publication Data

US 2017/0058486 A1 Mar. 2, 2017

(30) Foreign Application Priority Data

Feb. 14, 2014 (JP) ..... 2014-026854

(51) Int. Cl.
*F15B 21/14* (2006.01)
*E02F 9/12* (2006.01)
(Continued)

(52) U.S. Cl.
CPC ..... *E02F 9/123* (2013.01); *E02F 9/128* (2013.01); *E02F 9/2075* (2013.01); *E02F 9/226* (2013.01);
(Continued)

(58) Field of Classification Search
CPC ..... E02F 9/2285; E02F 9/2217; E02F 9/128; E02F 9/2075; E02F 9/2292; E02F 9/226;
(Continued)

(56) References Cited

U.S. PATENT DOCUMENTS

2014/0245729 A1* 9/2014 Nanjo ..... E02F 9/226 60/414

FOREIGN PATENT DOCUMENTS

EP 1 852 388 A1 11/2007
EP 2 426 363 A1 3/2012
(Continued)

OTHER PUBLICATIONS

International Search Report dated Mar. 31, 2015 for PCT/JP2015/050240 filed Jan. 7, 2015.
(Continued)

*Primary Examiner* — Michael Leslie
*Assistant Examiner* — Abiy Teka
(74) *Attorney, Agent, or Firm* — Oblon, McClelland, Maier & Neustadt, L.L.P.

(57) ABSTRACT

Provided is a hydraulic drive apparatus for a construction machine capable of achieving both of cavitation prevention and improvement of regeneration efficiency. The apparatus includes a regenerative motor configured to regenerate energy of hydraulic fluid discharged from a slewing motor, a first regeneration tank line for returning regeneration discharge fluid from the regenerative motor to a tank through a back pressure valve which is provided in a makeup line, a second regeneration tank line for returning the regeneration discharge fluid directly to the tank so as to bypass the back pressure valve, a regeneration-tank-line selector valve, and a regeneration-tank-line-selection control section configured to shift the regeneration-tank-line selector valve to pass the regeneration discharge fluid through the first regeneration
(Continued)

tank line during slewing deceleration and otherwise through the second regeneration tank line.

4 Claims, 4 Drawing Sheets

(51) Int. Cl.

| | |
|---|---|
| ***E02F 9/20*** | (2006.01) |
| ***E02F 9/22*** | (2006.01) |
| ***F15B 11/16*** | (2006.01) |
| ***F15B 13/02*** | (2006.01) |
| ***F15B 13/06*** | (2006.01) |
| *E02F 3/32* | (2006.01) |

(52) U.S. Cl.
CPC ..... *E02F 9/2217* (2013.01); *E02F 9/2285* (2013.01); *E02F 9/2292* (2013.01); *F15B 11/16* (2013.01); *F15B 13/024* (2013.01); *F15B 13/026* (2013.01); *F15B 13/06* (2013.01); *F15B 21/14* (2013.01); *E02F 3/32* (2013.01); *F15B 2211/6306* (2013.01); *F15B 2211/6336* (2013.01); *F15B 2211/7053* (2013.01); *F15B 2211/7058* (2013.01); *F15B 2211/71* (2013.01); *F15B 2211/7128* (2013.01); *F15B 2211/761* (2013.01); *F15B 2211/8609* (2013.01); *F15B 2211/88* (2013.01)

(58) Field of Classification Search
CPC ..... E02F 9/123; F15B 21/14; F15B 13/024; F15B 13/026; F15B 13/06; F15B 11/16
See application file for complete search history.

(56) References Cited

FOREIGN PATENT DOCUMENTS

| | | | | |
|---|---|---|---|---|
| JP | 2002-89505 | A | | 3/2002 |
| JP | 2003-120616 | A | | 4/2003 |
| JP | 2011-220390 | A | | 11/2011 |
| JP | 2011220390 | A | * | 11/2011 |
| JP | 2013-87831 | A | | 5/2013 |

OTHER PUBLICATIONS

Extended European Search Report dated Jan. 5, 2017 in Patent Application No. 15748708.3.

* cited by examiner

HYDRAULIC DRIVE APPARATUS FOR CONSTRUCTION MACHINE

TECHNICAL FIELD

The present invention relates to a hydraulic control apparatus provided in a construction machine such as a shovel, the hydraulic control apparatus performing energy regeneration during slewing deceleration or the like.

BACKGROUND ART

A background art of the present invention is explained with reference to a shovel shown in FIG. 3 as an example. The shovel includes a lower traveling body 1 of a crawler type, an upper slewing body 2 mounted so as to be capable of slewing around an axis X perpendicular to the ground, and a work attachment 3 attached to the upper slewing body 2. The work attachment 3 includes a boom 4 capable of being raised and lowered, an arm 5 attached to the distal end of the boom 4, a bucket 6 attached to the distal end of the arm 5, and a plurality of hydraulic cylinders for actuating the boom 4, the arm 5, and the bucket 6, respectively, namely, a boom cylinder 6, an arm cylinder 7, and a bucket cylinder 8. The shovel further includes a traveling motor, which is a hydraulic motor for causing the lower traveling body 1 to travel, and a slewing motor, which is a hydraulic motor for slewing the upper slewing body 2.

In the hydraulic shovel, during slewing deceleration, energy due to the inertia of the upper slewing body 2 is applied to the slewing motor. Besides, a load in a boom lowering direction due to the gravity acting on the attachment 3 or the like constantly acts on the boom cylinder 7, which constantly produce pressure in a fluid chamber of the boom cylinder 7 into which hydraulic fluid for extending the boom cylinder 7 is introduced. The fluid discharged from the fluid chamber has certain energy.

As means for effective utilization of such energy of a hydraulic actuator, there are known respective apparatuses described in Patent Literature 1 and 2. Each of techniques involves a regenerative motor connected to an engine. The regenerative motor is driven to rotate with fluid discharged from the hydraulic actuator to assist the engine. Alternatively, there is also known a hybrid shovel including a regenerative motor, a generator motor and an electric storage apparatus, wherein the regenerative motor drives the generator motor to thereby assist the engine and generated electric power is stored in the electric storage apparatus.

FIG. 4 shows a publicly-known technique described in Patent Literature 1. For simplification of explanation, FIG. 4 shows only constituent elements concerning slewing.

FIG. 4 shows an apparatus, which includes an engine 10, a hydraulic pump 11 functioning as a hydraulic pressure source driven by the engine 10, a slewing motor 12 which is rotated by pressure fluid from the hydraulic pump 11 to slew the upper slewing body 2, and a control valve 13 provided between the hydraulic pump 11 a tank T and the slewing motor 12. The control valve 13 is a hydraulically pilot controlled selector valve including a pair of pilot ports for receiving supply of a pilot pressure from a not-shown remote control valve, the selector valve being selectively operated by the pilot pressure. The control valve 13 changes supply-and-discharge state of hydraulic fluid to and from the slewing motor 12 to thereby enable control of an operation state of the slewing motor 12, specifically, control of rotation/stop, a rotating direction, and rotating speed of the slewing motor 12, to be performed.

Specifically, the control valve 13 has a neutral position 13*a*, a leftward-slewing position 13*b*, and a rightward-slewing position 13*c*. When no pilot pressure is supplied from the remote control valve to either of the pilot ports, the control valve 13 is retained in the neutral position 13*a*. When a pilot pressure is supplied from the remote control valve to any one of the pilot ports, the control valve 13 is shifted to a selected position of the leftward-slewing position 13*b* and the rightward-slewing position 13*c*, the selected position corresponding to the pilot port to which the pilot pressure is supplied.

In the neutral position 13*a*, the control valve 13 blocks a left-side slewing conduit 14 and a right-side slewing conduit 15, which connect the control valve 13 to left and right ports of the slewing motor 12, respectively, from the hydraulic pump 11, thereby hindering the slewing motor 12 from rotation. When shifted to the leftward-slewing position 13*b* by an operation applied to the remote control valve to a left slewing side, the control valve 13 allows the hydraulic fluid to be supplied from the hydraulic pump 11 to the leftward-slewing conduit 14, thereby rotating the slewing motor 12 leftward and slewing the upper slewing body 2 leftward. Conversely, when shifted to the rightward-slewing position 13*c* by operation applied to the remote control valve a right slewing side, the control valve 13 allows the hydraulic fluid from the hydraulic pump 11 to be supplied to the rightward-slewing conduit 15, thereby rotating the slewing motor 12 rightward to slew the upper slewing body 2 rightward.

The apparatus further includes a brake circuit 21. The brake circuit 21 includes left and right relief valves 16 and 17 provided as respective hydraulic brake valves and opposed to each other, left and right check valves 18 and 19 for anti-cavitation (for fluid suction) provided in parallel to the left and right relief valves 16 and 17 and opposed to each other, and a passage 20 interconnecting respective outlet ports of the left and right relief valves 16 and 17 and respective inlet ports of the left and right check valves 18 and 19. The hydraulic brake circuit 21 performs anti-cavitation action of returning fluid on a meter-out side to a meter-in side of the slewing motor 12 during slewing deceleration to prevent cavitation from occurrence and performs hydraulic brake action by the left and right relief valves 16 and 17.

Although not described in Patent Literature 1 and 2, the passage 20 of the hydraulic brake circuit 21 is usually connected to the tank T through a makeup line 22 for fluid pump-up. The makeup line 22A is provided with a back pressure valve (a boost check valve) 23, which produces a fixed back pressure, and an fluid cooler 24.

In the apparatus shown in FIG. 4, when returned to the neutral position 13*a* from, for example, the leftward-slewing position 13*b*, the control valve 13 separates the slewing motor 12 and both the slewing conduits 14 and 15 from the hydraulic pump 11 and the tank T to stop the supply of the hydraulic fluid to the slewing motor 12 and return of the hydraulic fluid from the slewing motor 12 to the tank T. However, the upper slewing body 2 continues the leftward slewing due to the inertia thereof, involving the slewing motor 12 to continue the rotation to produce pressure in the rightward-slewing conduit 15, which is a meter-out side conduit. When the pressure reaches a fixed value, the right relief valve 17 is opened to allow the hydraulic fluid in the rightward-slewing conduit 15 to flow into the slewing motor 12 passing through the right relief valve 17, the passage 20, the left check valve 18, and the leftward-slewing conduit 14, which is a meter-in conduit, in order.

Furthermore, when the pressure in the leftward-slewing conduit 14 is increased, the leftward-slewing conduit 14 sucks up the hydraulic fluid in the tank T through the makeup line 22 and the check valve 18 to thereby prevent cavitation. Thus, anti-cavitation act is automatically performed. The suction of the hydraulic fluid further applies a brake force to the slewing motor 12 rotated by the inertia of the upper slewing body 2 and thereby stops the slewing motor 12 gently. The action explained above is performed in the same manner during return of the control valve 13 from the rightward-slewing position 13*c* to the neutral position 13*a*. FIG. 4 indicates a flow of the fluid during the leftward slewing by white arrows and a black arrow, and indicates a flow of the hydraulic fluid for anti-cavitation by the black arrow.

The apparatus further includes a regenerative motor 25, which is a hydraulic motor for regeneration, a regeneration selector valve 26, a left regeneration line 27 and a right regeneration line 28. The regenerative motor 25 is coupled to the engine 10 and includes an inlet port connected to the regeneration selector valve 26 and an outlet port connected to the tank T. The regeneration selector valve 26 includes a pair of inlet ports connected to the left and rightward-slewing conduits 14 and 15 via the left and right regeneration lines 27 and 28, respectively, and the an outlet port connected to the regenerative motor 25.

The regeneration selector valve 26 has a neutral position 26*a* for blocking the regenerative motor 25 from the left and right regeneration lines 27 and 28, a left regeneration position 26*b* for connecting the regenerative motor 25 to the left regeneration line 27, and a right regeneration position 26*c* for connecting the regenerative motor 25 to the right regeneration line 28. These positions are selected according to a command input from a not-shown controller on the basis of operation of the remote control valve. The regeneration selector valve 26 is shifted to the left regeneration position 26*b*, for example, during leftward slewing deceleration, thereby allowing the hydraulic fluid discharged from the slewing motor 12 to flow into the regenerative motor 25 through the rightward-slewing conduit 15, which is the meter-out side conduit, the right regeneration line 27, and the regeneration selector valve 26 and to thereby rotate the regenerative motor 25. The driving of the regenerative motor 25 makes it possible to regenerate energy of the hydraulic fluid as rotational energy (in this case, as an engine assist force) to thereby enable the energy efficiency of a system to be improved.

However, in the apparatus wherein the hydraulic fluid discharged from the regenerative motor 25, namely, regeneration discharge fluid, is always directly returned to the tank T, the hydraulic fluid discharged from the slewing motor 12 during slewing deceleration returns to the tank T through the regenerative motor 25 without being supplied to the meter-in side, thereby permitting cavitation to be caused. This could be prevented by connecting an outlet side of the regenerative motor 25 to the makeup line 22 and returning the regeneration discharge fluid to the tank T through the back pressure valve 23 to produce back pressure; however, thus applying the back pressure to the regenerative motor 25 reduces an effective differential pressure and rotational speed of the regenerative motor 25 to deteriorate regeneration efficiency. Besides, while the hydraulic actuators connected to the regenerative motor 25 include an actuator with no risk of cavitation, the back pressure is uselessly applied also during actuation of the actuator with no risk to deteriorate the regeneration efficiency.

Patent Literature 2 discloses another cavitation prevention means including providing an accumulator as a hydraulic source for anti-cavitation, rotating the regenerative motor 25 with regenerative fluid extracted from the meter-out side of the slewing motor 12 during slewing deceleration, and supplying fluid in the accumulator to the meter-in side as anti-cavitation fluid. However, the technique requires large additional facilities, namely, a dedicated accumulator and an anti-cavitation circuit, thus involving an increase in facility costs and complication of a circuit.

CITATION LIST

Patent Literature

Patent Literature 1: Japanese Unexamined Patent Publication No. 2003-120616

Patent Literature 2: Japanese Unexamined Patent Publication No. 2011-220390

SUMMARY OF INVENTION

An object of the present invention is to provide a hydraulic drive apparatus for a construction machine capable of achieving both of cavitation prevention and improvement of regeneration efficiency without requiring a large facility. Provided is a hydraulic drive apparatus provided in a construction machine including a slewable upper slewing body, the hydraulic drive apparatus including: a plurality of hydraulic actuators including a slewing motor that slews the upper slewing body; a hydraulic pump configured to discharge hydraulic fluid for moving the hydraulic actuators; a regenerative motor driven by a part of the hydraulic fluid discharged from the hydraulic actuators to perform regenerative action; a hydraulic brake circuit including a relief valve and configured to perform anti-cavitation action for returning the hydraulic fluid on a meter-out side of the slewing motor to a meter-in side during deceleration of slewing of the upper slewing body to prevent cavitation from occurrence and to perform hydraulic brake action by the relief valve; a makeup line connecting the hydraulic brake circuit to a tank; a back pressure valve provided in the makeup line and configured to generate back pressure in the makeup line; a first regeneration tank line for returning regeneration discharge fluid, which is hydraulic fluid discharged from the regenerative motor, to the tank in a route in which the regeneration discharge fluid passes through the back pressure valve; a second regeneration tank line for returning the regeneration discharge fluid directly to the tank in a route in which the regeneration discharge fluid bypasses the back pressure valve; a regeneration-tank-line selector valve having a first position for allowing the regeneration discharge fluid to return to the tank through the first regeneration tank line and a second position for allowing the regeneration discharge fluid to return to the tank through the second regeneration tank line, the regeneration-tank-line selector valve being selectable between the first and second positions; a slewing deceleration detection section configured to detect that the slewing motor is in a deceleration state; and a regeneration-tank-line-selection control section configured to shift the regeneration-tank-line selector valve to the first position when the slewing deceleration detection section detects the deceleration state and shift the regeneration-tank-line selector valve to the second position when the slewing deceleration detection section does not detect the deceleration state.

DESCRIPTION OF EMBODIMENTS

Figure 2:
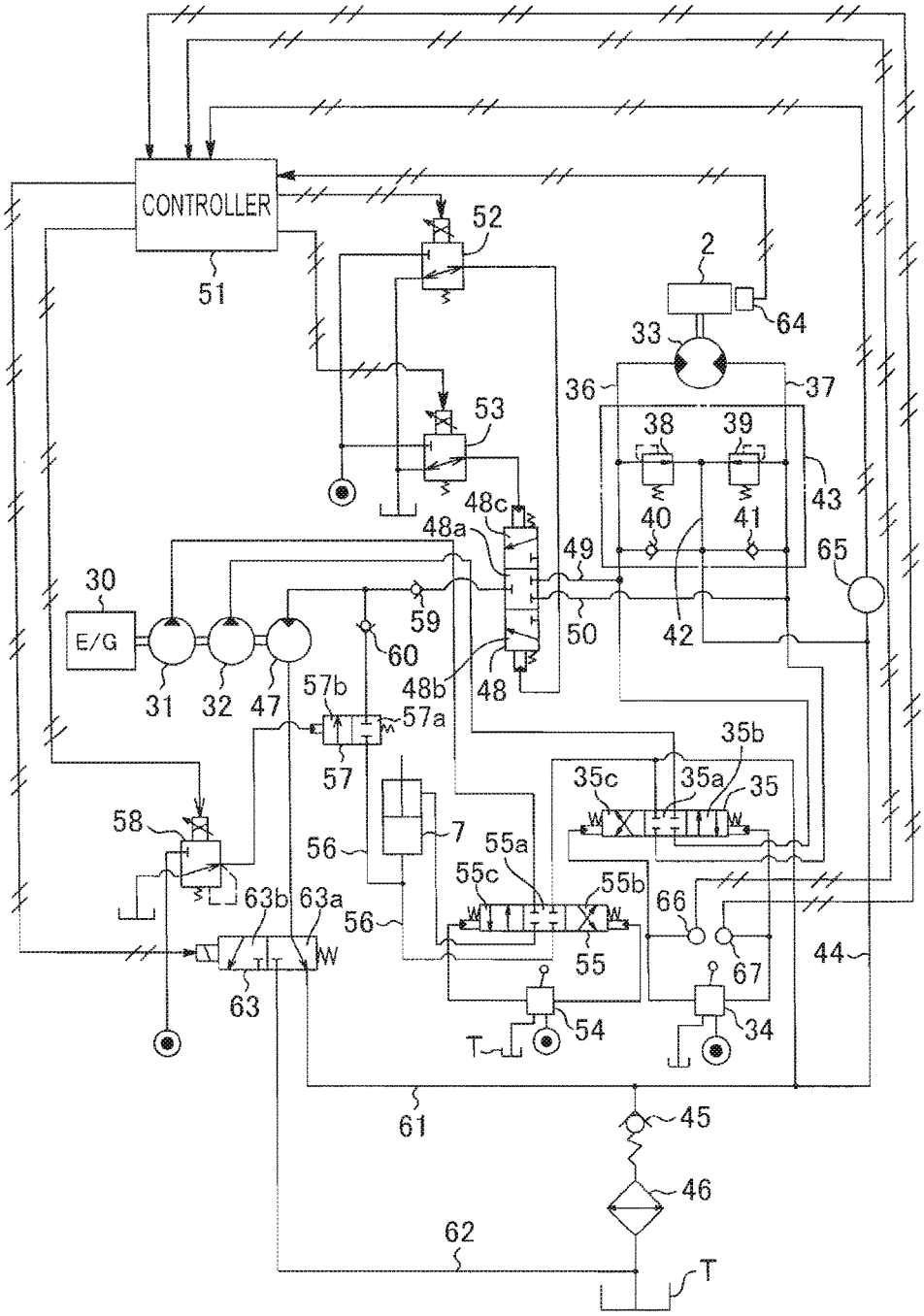
FIG. 2 is a circuit diagram showing a hydraulic drive apparatus according to a second embodiment of the present invention.
Figure 3:
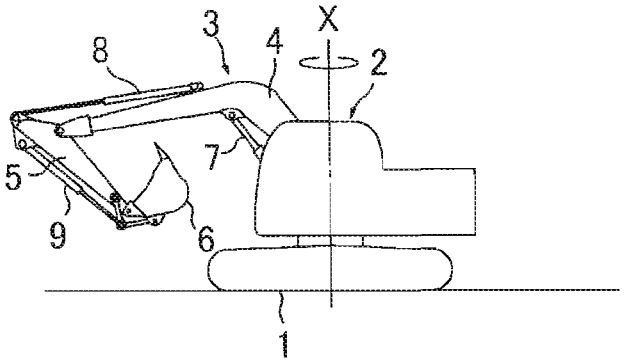
FIG. 3 is a side view of a shovel, which is an example of an application target of the present invention.
Figure 4:
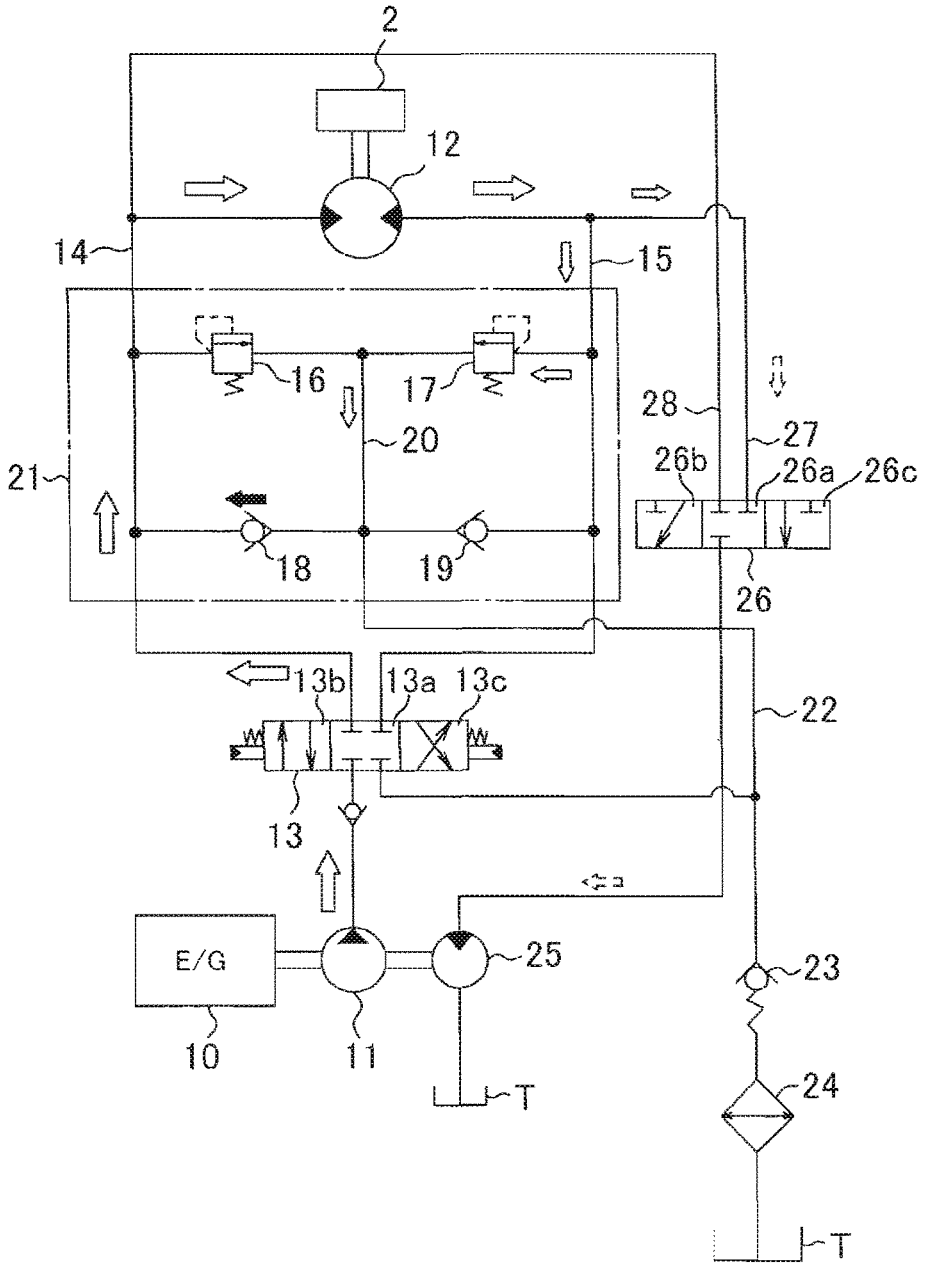
FIG. 4 is a circuit diagram showing a conventional hydraulic drive apparatus.

Respective hydraulic drive apparatuses according to first and second embodiments of the present invention are explained with reference to FIG. 1 and FIG. 2, respectively. Each apparatus is provided in a shovel shown in FIG. 3. To facilitate understanding of explanation, FIG. 1 and FIG. 2 show only a portion related to slewing in a hydraulic circuit and a boom cylinder circuit, which is a representative example of other hydraulic actuator circuits.

Figure 1:
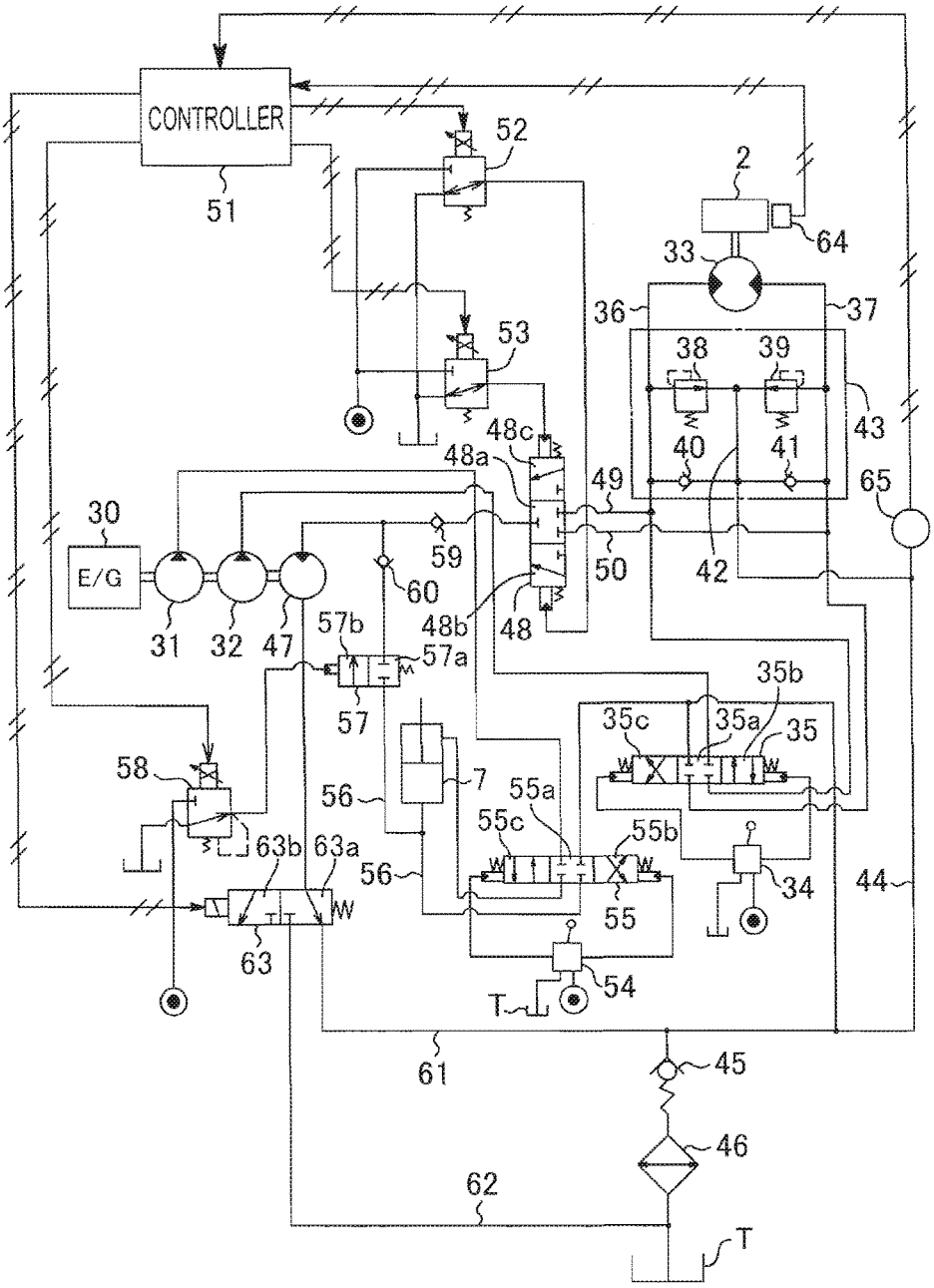
FIG. 1 is a circuit diagram showing a hydraulic drive apparatus according to a first embodiment of the present invention.

As shown in FIG. 1, the apparatus according to the first embodiment includes: a first hydraulic pump 31; a second hydraulic pump 32; a slewing motor 33 which is a hydraulic actuator that slews an upper slewing body 2; a slewing remote control valve 34, a slewing control valve 35, a leftward-slewing conduit 36, a rightward-slewing conduit 37, a brake circuit 43, and a makeup line 44.

The first and second hydraulic pumps 31 and 32 are driven by an engine 30 mounted on the shovel to thereby discharge hydraulic fluid in a tank T. The hydraulic fluid discharged from the first hydraulic pump 31 moves a boom cylinder 7, and the hydraulic fluid discharged from the second hydraulic pump 32 rotates the slewing motor 33.

The slewing motor 33 includes a left port and a right port. With supply of the hydraulic fluid to the left port, the slewing motor 33 is operated to slew the upper slewing body 2 leftward while discharging the hydraulic fluid through the right port. Conversely, with supply of the hydraulic fluid to the right port, the slewing motor 33 is operated to slew the upper slewing body 2 rightward while discharging the hydraulic fluid through the left port.

The remote slewing control valve 34 includes an operation lever and a valve main body and outputs a pilot pressure according to operation applied to the operation lever.

The slewing control valve 35 is interposed between the second hydraulic pump 32/the tank T and the slewing motor 33. The slewing control valve 35 is formed of a pilot-controlled selector valve, having a neutral position 35*a*, a leftward-slewing position 35*b*, and a rightward-slewing position 35*c*. The position of the slewing control valve 35 is changed by the pilot pressure input from the remote slewing control valve 34. By the selection of the position of the slewing control valve 35, performed is control of supply and discharge of the hydraulic fluid to and from the slewing motor 33, specifically, control of rotation/stop, a rotating direction, and rotating speed of the slewing motor 12.

The slewing control valve 35 includes a pump port connected to the second pump 32, a tank port connected to the tank T, a left motor port, and a right motor port. The leftward-slewing conduit 36 connects the left motor port and the left port of the slewing motor 33. The rightward-slewing conduit 37 connects the right motor port and the right port of the slewing motor 33.

The hydraulic brake circuit 43 includes left and right relief valves 38 and 39, left and right check valves 40 and 41, and a passage 42.

The left and right relief valves 38 and 39 are provided between the leftward-slewing conduit 36/the rightward-slewing conduit 37 and the passage 42 and function as brake valves for leftward slewing and rightward slewing, respectively. Specifically, the left relief valve 38 is interposed between the leftward-slewing conduit 36 and the passage 42 and is opened, when the pressure of the hydraulic fluid in the leftward-slewing conduit 36 is equal to or larger than fixed pressure, to bring the leftward-slewing conduit 36 and the passage 42 into communication with each other. Similarly, the right relief valve 39 is interposed between the rightward-slewing conduit 37 and the passage 42 and is opened, when the pressure of the hydraulic fluid in the rightward-slewing conduit 37 is equal to or larger than fixed pressure, to bring the rightward-slewing conduit 37 and the passage 42 into communication with each other. The passage 42 is connected to the tank T through the makeup line 44.

The left and right check valves 40 and 41 are provided between the leftward-slewing conduit 36/the rightward-slewing conduit 37 and the passage 42, allowing only a flow of the hydraulic fluid from the passage 42 to the left and rightward-slewing conduits 36 and 37, respectively, and block a flow opposite to the flow.

The hydraulic brake circuit 43 including the components explained above performs anti-cavitation action for returning the hydraulic fluid on the meter-out side of the slewing motor 33 to the meter-in side to prevent cavitation from occurrence during slewing deceleration and hydraulic brake action by the relief valves 38 and 39.

The makeup line 44 is provided with a back pressure valve 45 and an fluid cooler 46. The back pressure valve 45 is opened only when primary pressure thereof is equal to or larger than fixed pressure to thereby generate back pressure in the makeup line 44 on a primary side of the back pressure valve 45.

In the apparatus, when returned, for example, from the leftward-slewing position 35*b* to the neutral position 35*a*, the slewing control valve 35 separates the slewing motor 33 and both of the slewing conduits 36 and 37 from the second hydraulic pump 32 and the tank T to stop the supply of the hydraulic fluid to the slewing motor 33 and the return of the hydraulic fluid from the slewing motor 12 to the tank T. However, the upper slewing body 2 continues the leftward slewing with the inertia thereof, involving the slewing motor 33 to continue the rotation in association therewith to produce pressure in the rightward-slewing conduit 37, which is a meter-out side conduit. When the pressure reaches a fixed value, the right relief valve 39 is opened to allow the hydraulic fluid in the rightward-slewing conduit 37 to flow into the slewing motor 33 passing through the right relief valve 39, the passage 42, the left check valve 40, and the leftward-slewing conduit 36, which is a meter-in conduit, in order.

Furthermore, when the pressure in the leftward-slewing conduit 14 is reduced to be, for example, negative pressure, the leftward-slewing conduit 14 sucks up the hydraulic fluid in the tank T through the makeup line 22 and the check valve 18 to thereby prevent cavitation. Thus, anti-cavitation action is automatically performed. The suction of the hydraulic fluid, furthermore, applies a brake force to the slewing motor 12 rotated by the inertia of the upper slewing body 2, gently stopping the slewing motor 12. The action explained above is performed in the same manner during return from the rightward-slewing position 13*c* to the neutral position 13*a* of the control valve 13.

The apparatus further includes a regenerative motor 47, which is a hydraulic motor for regeneration, a regeneration selector valve for slewing 48, and a left regeneration line 49 and a right regeneration line 28. The regenerative motor 47 is coupled to the engine 10 and includes an inlet port connected to the slewing regeneration selector valve 48 and an outlet port connectable to the tank T. The slewing regeneration selector valve 48 includes a pair of inlet ports connected to the left and rightward-slewing conduits 36 and 37 via the left and right regeneration lines 49 and 50, respectively, and an outlet port connected to the regenerative motor 47. The slewing regeneration selector valve 48 is formed of a hydraulic selector valve including a pair of pilot ports, having a neutral position 48*a* for blocking the regenerative motor 47 from the left and right regeneration lines 49 and 50, a left regeneration position 48*b* for connecting the regenerative motor 47 to the left regeneration line 49, and a right regeneration position 48*c* for connecting the regenerative motor 47 to the right regeneration line 50.

The apparatus further includes a controller 51 and electromagnetic proportional decompression valves 52 and 53 for changing the position of the slewing regeneration selector valve 48. The electromagnetic proportional decompression valves 52 and 53 are interposed between the pair of pilot ports of the slewing regeneration selector valve 48 and a pilot hydraulic source for the slewing regeneration selector valve 48, respectively. The controller 51 outputs a command signal to the electromagnetic proportional decompression valves 52 and 53 on the basis of operation applied to the operation lever of the remote slewing control valve 34 to adjust a pilot pressure input to the pilot ports of the slewing regeneration selector valve 48, thereby performing control of selection of the position of the slewing regeneration selector valve 48.

The controller 51 shifts the slewing regeneration selector valve 48 to the left regeneration position 48*b* during leftward slewing deceleration and shifts the stewing regeneration selector valve 48 to the right regeneration position 48*c* during the rightward slewing deceleration. When shifted to, for example, the left regeneration position 48*b* during the left slewing deceleration, the slewing regeneration selector valve 48 allows the hydraulic fluid discharged from the slewing wing motor 33 to flow into the regenerative motor 47 through the rightward-slewing wing conduit 37, which is the meter-out side conduit, the right regeneration line 50, and the slewing regeneration selector valve 48 to rotate the regenerative motor 47. The driving of the regenerative motor 47 makes it possible to regenerate energy of the hydraulic fluid as rotation energy (in this case, an engine assist force).

On the other hand, the apparatus includes, as elements for moving the boom cylinder 7, a boom remote control valve 54, a boom control valve 55, a boom lowering regeneration line 56, and a boom regeneration selector valve 57.

The boom control valve 55 is interposed between the first hydraulic pump 31/the tank T and the boom cylinder 7. The boom control valve 55 is a pilot-controlled selector valve, having a neutral position 55*a* for stopping the boom cylinder 7, an extension position 55*b* for extending the boom cylinder 7, and a retraction position 55*c* for retracting the boom cylinder 7. The position of the boom control valve 55 is changed in accordance with the operation applied to the boom remote control valve 54.

The boom lowering regeneration line 56 connects a head-side fluid chamber, that is, an extension-side fluid chamber of the boom cylinder 7, to an inlet side of the regenerative motor 47. The boom regeneration selector valve 57 is provided halfway in the boom lowering regeneration line 56 and has a blocking position 57*a* for blocking the boom lowering regeneration line 56 and an opening position 57*b* for opening the boom lowering regeneration line 56.

The boom regeneration selector valve 57 is a hydraulic selector valve including a pilot port. An electromagnetic proportional decompression valve 58 is interposed between the pilot port and a pilot hydraulic source for the boom regeneration selector valve 57. The controller 51 inputs a command signal to the electromagnetic proportional decompression valve 58 so as to shift the boom regeneration selector valve 57 from the blocking position 57*a* to the opening position 57*b* when the boom remote control valve 54 is operated to lower the boom. The boom regeneration selector valve 57 thus shifted to the opening position 57*b* allows a part of the hydraulic fluid discharged from the boom cylinder 7 during the boom lowering operation to flow into the regenerative motor 47 in the same manner as during the slewing, thereby enabling the regenerative motor 47 to be driven by the hydraulic fluid discharged from other hydraulic actuators including the slewing motor 33 and the boom cylinder 7. The apparatus, besides, includes check valves 59 and 60 for backflow prevention interposed between the slewing and boom regeneration selector valves 48 and 57 and an inlet of the regenerative motor 47, respectively.

The apparatus includes a plurality of sensors, which include a speed sensor 64 as a speed detection device and a pressure sensor 65 as a pressure detection device. The speed sensor 64, which is formed of, for example, a gyro, detects rotational speed of the slewing motor 33, in other words, slewing speed of the upper slewing body 2. The pressure sensor 65 detects a makeup pressure, which is the pressure in the makeup line 44. A speed signal and a pressure signal generated by the speed sensor 64 and the pressure sensor 65, respectively, are input to the controller 51. The speed sensor 64 is capable of constituting, in conjunction with the controller 51, a slewing deceleration detection section which detects that slewing of the upper slewing body 2 is in a deceleration state.

Furthermore, as tank lines for returning regeneration discharge fluid, which is hydraulic fluid discharged from the regenerative motor 47, to the tank T, the apparatus includes a pair of a first regeneration tank line 61 and a second regeneration tank line 62. The first regeneration tank line 61 is a line for returning the regeneration discharge fluid to the tank T in a route in which the regeneration discharge fluid passes through the back pressure valve 45 of the makeup line 44. The second regeneration tank line 62 is a line for returning the regeneration discharge fluid directly to the tank T in a route in which the regeneration discharge fluid bypasses the back pressure valve 45.

Besides, the apparatus includes a regeneration-tank-line selector valve 63 that selects a tank line to be used from the first and second regeneration tank lines 61 and 62. The regeneration-tank-line selector valve 63 is interposed between the first and second regeneration tank lines 61 and 62 and an outlet side of the regenerative motor 47. The regeneration-tank-line selector valve 63 is formed of an electromagnetic selector valve including a solenoid, having a position for leading the regeneration discharge fluid to the first regeneration tank line 61, namely, a first position 63*a* for allowing the regeneration discharge fluid to return to the tank T through the first regeneration tank line 61, and a position for leading the regeneration discharge fluid to the second regeneration tank line 62, namely, a second position 63*b* for allowing the regeneration discharge fluid to return to the tank through the second regeneration tank line.

The controller 51 inputs a command signal to the solenoid of the regeneration-tank-line selector valve 63 as appropriate, thereby changing the position of the regeneration-tank-line selector valve 63 between the first position 63*a* and the second position 63*b*. The controller 51, thus, includes a regeneration-tank-line-selection control section that changes the position of the regeneration-tank-line selector valve 63.

In addition, the controller 51 includes a deceleration-state judgment section that judges, on the basis of a change in a speed signal generated by the speed sensor 64, whether slewing of the upper slewing body 2 is in a deceleration state. When judging that the slewing of the upper slewing body 2 is in the deceleration state, the regeneration-tank-line-selection control section shifts the regeneration-tank-line selector valve 63 to the first position 63*a*. Otherwise, for example, during slewing driving or during boom lowering operation, the regeneration-tank-line-selection control section shifts the regeneration-tank-line selector valve 63 to the second position 63*b*. The deceleration-state judgment section, thus, constitutes a slewing-speed detection section in conjunction with the speed sensor 64, which is a slewing speed detection device.

This apparatus allows, during the slewing deceleration, the regeneration discharge fluid from the regenerative motor 47 to be returned to the tank T through the first regeneration tank line 61, that is, in the route in which the regeneration discharge fluid passes through the back pressure valve 45, thereby enabling the back pressure valve 45 to produce back pressure in the makeup line 44. This makes it possible to cause the regenerative motor 47 to perform regenerative action, while ensuring the anti-cavitation action performed by the hydraulic brake circuit 43 to prevent the slewing motor 33 from cavitation.

On the other hand, during the operation except the slewing deceleration, the regeneration discharge fluid is returned directly to the tank T through the second regeneration tank line 62, that is, directly to the tank T so as to bypass the back pressure valve 45, thereby increasing an effective differential pressure (an inlet pressure-an outlet pressure) in the regenerative motor 47 to increase the rotational speed of the regenerative motor 47. This allows the regeneration efficiency by the regenerative motor 47 to be improved.

Through the above process, both of the prevention of cavitation and the improvement of regeneration efficiency are achieved.

In addition, the controller 51 constituting a part of the slewing deceleration detection section judges whether slewing is in the deceleration state on the basis on the slewing speed detected by the speed sensor 64, that is, the direct detection of actual movement of the stewing motor 33, thereby enabling accurate selection control without erroneous detection to be performed.

Moreover, the effect can be obtained by addition of the regeneration-tank-line selector valve 63 and one of the first and second regeneration tank lines 61 and 62 to the existing facility, thus involving no marked increase in facility costs and no complication of a circuit.

Besides, during mixed operation where slewing and actuation of another hydraulic actuator including the boom cylinder 7 are simultaneously performed, there is a possibility that discharged fluid from the other hydraulic actuator passes through the back pressure valve 45 to produce back pressure in the makeup line 44. This case involves no risk of occurrence of cavitation in a slewing circuit even during the slewing deceleration. Hence, it is preferable that the controller 51 performs control for setting the regeneration-tank-line selector valve 63 in the second position 63*b* even during the slewing deceleration, when the makeup pressure detected by the pressure sensor 65 is equal to or larger than a predetermined value, for example, a pressure equivalent to back pressure by the back pressure valve 45. Specifically, the regeneration-tank-line selector valve 63 shown in FIG. 1, can be retained in the second position 63*b* by no input of a selection signal by the controller 51 to the regeneration-tank-line selector valve 63. This makes it possible to increase an effective differential pressure in the regenerative motor 47 to improve regeneration efficiency even during the slewing deceleration.

FIG. 2 shows an apparatus according to a second embodiment of the present invention. From the apparatus according to the first embodiment, the apparatus is different only in the configuration of a slewing deceleration detection section. Specifically, the apparatus according to the second embodiment includes remote control pressure sensors 66 and 67 that detect remote respective control pressures, which are pilot pressures supplied from a slewing operation device to the pilot ports of the slewing control valve 35, the slewing operation device being the remote slewing control valve 34 which receives operation with respect to slewing of the upper slewing body 2 and outputs the pilot pressures that are command signals with respect to the slewing.

The remote control pressure sensors 66 and 67 correspond to slewing operation detection devices that detect the respective remote control pressures, that is, command signals for slewing output from the remote slewing control valve 34 as the slewing operation device, generating remote control pressure detection signals corresponding to the remote control pressure and inputting the remote control pressure detection signals to the controller 51. The controller 51 includes a deceleration-state judgment section that judges whether the slewing of the upper slewing body 2 is in the deceleration state, based on a change in the remote control pressure. The slewing operation detection devices and the deceleration-state judgment section constitute the slewing deceleration detection section.

In the apparatus, the remote slewing control valve 34 is an element originally equipped as the slewing operation device for performing slewing operation in a hydraulic shovel and the remote control pressure sensors 66 and 67 are standard elements equipped as the slewing operation detection devices for pump control or the like; therefore, the detection of the deceleration state of the slewing by utilization of them enables further simplification of the configuration of a circuit and a reduction in facility costs.

Besides, the present invention also includes, for example, embodiments explained below.

(1) In the present invention, a form of collecting energy generated by the regenerative motor is not limited. While the regenerative motor 47 according to the first and second embodiments is coupled to the engine 30 to assist it, it is also possible, for example, to drive a generator motor in a hybrid shovel by the regenerative motor according to the present invention to assist an engine and store electric power generated by the generator motor in an electric storage apparatus, or to drive a generator unrelated to the engine by the regenerative motor according to the present invention to store electric power generated by the generator in the electric storage apparatus.

(2) A construction machine provided with the apparatus according to the present invention is not limited to a hydraulic shovel. The present invention can be also applied to other construction machines, for example, a construction machine capable of driving an upper slewing body with a slewing motor similarly to the shovel and driving a regenerative motor with discharge fluid from a hydraulic actuator including the slewing motor.

As explained above, provided is a hydraulic drive apparatus for a construction machine capable of achieving both of cavitation prevention and improvement of regeneration efficiency without requiring a large facility. The apparatus is a hydraulic drive apparatus provided in a construction machine including an upper slewing body capable of slewing, including: a plurality of hydraulic actuators including a slewing motor that slews the upper slewing body; a hydraulic pump configured to discharge hydraulic fluid for moving the hydraulic actuators; a regenerative motor driven by a part of the hydraulic fluid discharged from the hydraulic actuators to perform regenerative action; a hydraulic brake circuit including a relief valve and configured to perform anti-cavitation action for returning the hydraulic fluid on a meter-out side of the slewing motor to a meter-in side during deceleration of slewing of the upper slewing body to prevent cavitation from occurrence and to perform hydraulic brake action by the relief valve; a makeup line connecting the hydraulic brake circuit to a tank; a back pressure valve provided in the makeup line to generate back pressure in the makeup line; a first regeneration tank line for returning regeneration discharge fluid, which is hydraulic fluid discharged from the regenerative motor, to the tank in a route in which the regeneration discharge fluid passes through the back pressure valve; a second regeneration tank line for returning the regeneration discharge fluid directly to the tank in a route in which the regeneration discharge fluid bypasses the back pressure valve; a regeneration-tank-line selector valve having a first position for allowing the regeneration discharge fluid to return to the tank through the first regeneration tank line and a second position for allowing the regeneration discharge fluid to return to the tank through the second regeneration tank line, the regeneration-tank-line selector valve being selectable between the first and second positions; a slewing deceleration detection section configured to detect that the slewing motor is in a deceleration state; and a regeneration-tank-line-selection control section configured to shift the regeneration-tank-line selector valve to the first position when the slewing deceleration detection section detects the deceleration state and shift the regeneration-tank-line selector valve to the second position when the slewing deceleration detection section does not detect the deceleration state.

The apparatus, configured to return the regeneration discharge fluid discharged from the regenerative motor to the tank through the first regeneration tank line via the back pressure valve during slewing deceleration and to directly return the regeneration discharge fluid to the tank through the second regeneration tank line bypassing the back pressure valve, is capable of improving regeneration efficiency while preventing cavitation. Moreover, this effect can be achieved by addition of simple and inexpensive facilities, that is, the addition of the regeneration-tank-line selector valve and the second regeneration tank line, thus involving no marked increase in facility costs and no complication of a circuit configuration.

Preferably, the hydraulic driving apparatus further includes a pressure detection device configured to detect pressure in the makeup line and the regeneration-tank--line-selection control section is configured to shift the regeneration-tank-line selector valve to the second position, irrespective of detection of the deceleration state, when the pressure detected by the pressure detection device is equal to or larger than a preset value of pressure and equivalent to back pressure generated by the back pressure valve.

The apparatus is capable of improving regeneration efficiency by use of the second regeneration tank line when the pressure in the makeup line is large even though the deceleration state of the slewing is detected. For example, during mixed operation where slewing and actuation of another hydraulic actuator including the boom cylinder are simultaneously performed, there is a possibility that discharged fluid from the other hydraulic actuator passes through the back pressure valve to produce back pressure in the makeup line, which does not allow the pressure in the makeup line to be reduced even with direct return of the regeneration discharge fluid to the tank through the second regeneration tank line. Therefore, it is possible to increase an effective differential pressure of the regenerative motor by direct return of the regeneration discharge fluid to the tank to improve regeneration efficiency while avoiding cavitation.

The slewing deceleration detection section according to the present invention suitably includes, for example, a slewing speed detection device configured to detect slewing speed of the upper slewing body and a deceleration-state judgment section configured to judge, on the basis of a change in the slewing speed detected by the slewing speed detection device, whether the slewing is in the deceleration state. The slewing deceleration detection section detects actual slewing speed of the upper slewing body, that is, an actual movement of the slewing motor, directly and judges the deceleration state of the slewing based on the actual movement, thus enabling accurate selection control with low likelihood of erroneous detection.

Alternatively, the slewing deceleration detection section according to the present invention may include a slewing operation device configured to receive operation with respect to slewing of the upper slewing body such as slewing drive, slewing stop, or slewing deceleration and to output a command signal for the slewing, a slewing operation detection device configured to detect a command signal output by the slewing operation device, and a deceleration-state judgment section configured to judge, on the basis of the command signal detected by the slewing operation detection device, whether the slewing is in the deceleration state. The slewing deceleration detection section, utilizing a slewing operation device and a slewing operation detection device originally used for slewing operation of the upper slewing body, pump control, and the like, can detect the deceleration state with a simple circuit configuration and low facility costs.

The invention claimed is:

1. A hydraulic drive apparatus provided in a construction machine including an upper slewing body capable of slewing, the hydraulic drive apparatus comprising:

a plurality of hydraulic actuators including a first hydraulic actuator and a second hydraulic actuator, the second hydraulic actuator being a slewing motor that slews the upper slewing body;

a first hydraulic pump configured to discharge hydraulic fluid for moving the first hydraulic actuator;

a second hydraulic pump configured to discharge hydraulic fluid for moving the second hydraulic actuator:

a regenerative motor driven by a part of the hydraulic fluid discharged from the hydraulic actuators to perform regenerative action;

a hydraulic brake circuit including a relief valve and configured to perform anti-cavitation action for returning the hydraulic fluid on a meter-out side of the slewing motor to a meter-in side during deceleration of slewing of the upper slewing body to prevent cavitation from occurrence and to perform hydraulic brake action by the relief valve;

a makeup line connecting the hydraulic brake circuit to a tank;

a back pressure valve provided in the makeup line and configured to generate back pressure in the makeup line;

a first regeneration tank line for returning regeneration discharge fluid, which is hydraulic fluid discharged from the regenerative motor, to the tank in a route in which the regeneration discharge fluid passes through the back pressure valve;

a second regeneration tank line for returning the regeneration discharge fluid directly to the tank in a route in which the regeneration discharge fluid bypasses the back pressure valve;

a regeneration-tank-line selector valve having a first position for allowing the regeneration discharge fluid to return to the tank through the first regeneration tank line and a second position for allowing the regeneration discharge fluid to return to the tank through the second regeneration tank line, the regeneration-tank-line selector valve being selectable between the first and second positions;

a slewing deceleration detection section configured to detect that the slewing motor is in a deceleration state; and a regeneration-tank-line-selection control section configured to shift the regeneration-tank-line selector valve to the first position when the slewing deceleration detection section detects the deceleration state and shift the regeneration-tank-line selector valve to the second position when the slewing deceleration detection section does not detect the deceleration state.

2. The hydraulic drive apparatus for the construction machine according to claim 1, further comprising a pressure detection device configured to detect pressure in the makeup line, wherein the regeneration-tank-line-selection control section shifts the regeneration-tank-line selector valve to the second position, irrespective of detection of the deceleration state, when the pressure detected by the pressure detection device is equal to or large than a preset value of pressure and equivalent to the back pressure generated by the back pressure valve.

3. The hydraulic drive apparatus for the construction machine according to claim 1, wherein the slewing deceleration detection section includes a slewing speed detection device configured to detect slewing speed of the upper slewing body and a deceleration-state judgment section configured to judge, on the basis of a change in the slewing speed detected by the slewing speed detection device, whether the slewing is in the deceleration state.

4. The hydraulic drive apparatus for the construction machine according to claim 1, wherein the slewing deceleration detection section includes a slewing operation device configured to receive operation with respect to slewing of the upper slewing body and to output a command signal for the slewing, a slewing operation detection device configured to detect the command signal output by the slewing operation device and a deceleration-state judgment section configured to judge, on the basis of the command signal detected by the slewing operation detection device, whether the slewing is in the deceleration state.

* * * * *